US010854183B2

(12) United States Patent
Yamazoe et al.

(10) Patent No.: US 10,854,183 B2
(45) Date of Patent: Dec. 1, 2020

(54) SOUNDPROOF STRUCTURE

(71) Applicant: FUJIFILM Corporation, Tokyo (JP)

(72) Inventors: Shogo Yamazoe, Ashigara-kami-gun (JP); Shinya Hakuta, Ashigara-kami-gun (JP); Tadashi Kasamatsu, Ashigara-kami-gun (JP); Masayuki Naya, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 485 days.

(21) Appl. No.: 15/822,638

(22) Filed: Nov. 27, 2017

(65) Prior Publication Data

US 2018/0082668 A1 Mar. 22, 2018

Related U.S. Application Data

(63) Continuation of application No. PCT/JP2016/068241, filed on Jun. 20, 2016.

(30) Foreign Application Priority Data

Jun. 22, 2015 (JP) ..... 2015-124689
Apr. 28, 2016 (JP) ..... 2016-090493

(51) Int. Cl.
*G10K 11/16* (2006.01)

(52) U.S. Cl.
CPC ..... *G10K 11/16* (2013.01)

(58) Field of Classification Search
CPC ..... G10K 11/16
(Continued)

(56) References Cited

U.S. PATENT DOCUMENTS 7,395,898 B2 7/2008 Yang et al.
8,616,330 B1 * 12/2013 McKnight ..... G10K 11/16 181/207
(Continued)

FOREIGN PATENT DOCUMENTS

JP 2000-330571 A 11/2000
JP 2009-139556 A 6/2009
(Continued)

OTHER PUBLICATIONS

International Preliminary Report on Patentability and Written Opinion of the International Searching Authority (Forms PCT/IB/326, PCT/IB/373 and PCT/ISA/237) for Application No. PCT/JP2016/068241, dated Jan. 4, 2018, with an English translation.
(Continued)

*Primary Examiner* — Forrest M Phillips
(74) *Attorney, Agent, or Firm* — Birch, Stewart, Kolasch & Birch, LLP

(57) ABSTRACT

There is provided a soundproof structure which is light and thin, which has air permeability so that wind and heat can pass therethrough and accordingly no heat accumulates on the inside, and which is suitable for equipment, automobiles, and household applications. The soundproof structure has one or more soundproof cells. Each soundproof cell includes a frame having a through-hole through which sound passes, a film fixed to the frame, an opening portion configured to include one or more holes drilled in the film, and a weight disposed on the film. The soundproof structure has a first shielding peak frequency, which is determined by the opening portion drilled in the film and at which a transmission loss is maximized, on a lower frequency side than a first natural vibration frequency of the film of each soundproof cell and a second shielding peak frequency, which is determined by the weight and at which a transmission loss is maximized, on a higher frequency side than the first natural
(Continued)

vibration frequency of the film, and selectively insulates sound in a predetermined frequency band centered on the first shielding peak frequency and sound in a predetermined frequency band centered on the second shielding peak frequency.

16 Claims, 11 Drawing Sheets

(58) Field of Classification Search
USPC ..... 181/288
See application file for complete search history.

(56) References Cited

U.S. PATENT DOCUMENTS 8,857,563 B1 * 10/2014 Chang ..... H03H 9/25 181/286
8,869,933 B1 * 10/2014 McKnight ..... G10K 11/172 181/207
8,960,365 B2 * 2/2015 Sheng ..... G10K 11/16 181/207
10,099,317 B2 * 10/2018 Hakuta ..... B23K 26/382
2011/0240402 A1 10/2011 Chou et al.

FOREIGN PATENT DOCUMENTS

JP 2009-204836 A 9/2009
JP 4832245 B2 12/2011

OTHER PUBLICATIONS

International Search Report and English translation (Form PCT/ISA/210) for Application No. PCT/JP2016/068241, dated Sep. 6, 2016.

* cited by examiner

SOUNDPROOF STRUCTURE

CROSS-REFERENCE TO RELATED APPLICATIONS

This application is a Continuation of PCT International Application No. PCT/JP2016/068241 filed on Jun. 20, 2016, which claims priority under 35 U.S.C. § 119(a) to Japanese Patent Application No. 2015-124689 filed on Jun. 22, 2015 and Japanese Patent Application No. 2016-090493 filed on Apr. 28, 2016. Each of the above applications is hereby expressly incorporated by reference, in its entirety, into the present application.

BACKGROUND OF THE INVENTION

1. Field of the Invention

The present invention relates to a soundproof structure.

2. Description of the Related Art

In the case of a general sound insulation material, as the mass increases, the sound is more effectively shielded. Accordingly, in order to obtain a good sound insulation effect, the sound insulation material itself becomes large and heavy. On the other hand, in particular, it is difficult to shield the sound of low frequency components. In general, this region is called a mass law, and it is known that the shielding increases by 6 dB in a case where the frequency doubles.

Thus, most of the conventional soundproof structures are disadvantageous in that the soundproof structures are large and heavy due to sound insulation by the mass of the structures and that it is difficult to shield low frequencies.

For this reason, as a sound insulation material corresponding to various situations, such as equipment, automobiles, and general households, a light and thin sound insulation structure has been demanded. In recent years, therefore, a sound insulation structure for controlling the vibration of a film by attaching a frame to a thin and light film structure has been drawing attention (refer to JP4832245B, U.S. Pat. No. 7,395,898B (corresponding Japanese Patent Application Publication: JP2005-250474A), and JP2009-139556A).

In the case of these structures, the principle of sound insulation is a stiffness law different from the mass law described above. Accordingly, low frequency components can be further shielded even with a thin structure. This region is called a stiffness law, and the behavior is the same as in a case where a film has a finite size matching a frame opening portion since the film vibration is fixed at the frame portion.

JP4832245B discloses a sound absorber that has a frame body, which has a through-hole formed therein, and a sound absorbing material, which covers one opening of the through-hole and whose first storage modulus E1 is $9.7\times10^6$ or more and second storage modulus E2 is 346 or less (refer to abstract, claim 1, paragraphs [0005] to [0007] and [0034], and the like). The storage modulus of the sound absorbing material means a component, which is internally stored, of the energy generated in the sound absorbing material by sound absorption.

In JP4832245B, in the embodiment, by using a sound absorbing material containing a resin or a mixture of a resin and a filler as a mixing material, it is possible to obtain the peak value of the sound absorption rate in the range of 0.5 to 1.0 and the peak frequency in the range of 290 to 500 Hz and to achieve a high sound absorption effect in a low frequency region of 500 Hz or less without causing an increase in the size of the sound absorber.

In addition, U.S. Pat. No. 7,395,898B (corresponding Japanese Patent Application Publication: JP2005-250474A) discloses a sound attenuation panel including an acoustically transparent two-dimensional rigid frame divided into a plurality of individual cells, a sheet of flexible material fixed to the rigid frame, and a plurality of weights, and a sound attenuation structure (refer to claims 1, 12, and 15, FIG. 4, page 4, and the like). In the sound attenuation panel, the plurality of individual cells are approximately two-dimensional cells, each weight is fixed to the sheet of flexible material so that the weight is provided in each cell, and the resonance frequency of the sound attenuation panel is defined by the two-dimensional shape of each cell individual cell, the flexibility of the flexible material, and each weight thereon.

U.S. Pat. No. 7,395,898B (corresponding Japanese Patent Application Publication: JP2005-250474A) discloses that the sound attenuation panel has the following advantages compared with the related art. That is, (1) the sound attenuation panel can be made very thin. (2) The sound attenuation panel can be made very light (with a low density). (3) The panel can be laminated together to form wide-frequency range locally resonant sonic materials (LRSM) since the panel does not follow the mass law over a wide frequency range, and in particular, this can deviate from the mass law at frequencies lower than 500 Hz. (4) The panel can be easily and inexpensively manufactured (refer to page 5, line 65 to page 6, line 5).

JP2009-139556A discloses a sound absorber which is partitioned by a partition wall serving as a frame and is closed by a rear wall (rigid wall) of a plate-shaped member and in which a film material (film-shaped sound absorbing material) covering an opening portion of the cavity whose front portion is the opening portion is covered, a pressing plate is placed thereon, and a resonance hole for Helmholtz resonance is formed in a region (corner portion) within a range of 20% of the size of the surface of the film-shaped sound absorbing material from the fixed end of the peripheral portion of the opening portion that is a region where the displacement of the film material due to sound waves hardly occurs. In the sound absorber, the cavity is blocked except for the resonance hole. The sound absorber performs both a sound absorbing action by film vibration and a sound absorbing action by Helmholtz resonance.

SUMMARY OF THE INVENTION

Incidentally, since the sound absorber disclosed in JP4832245B is light and the peak value of the sound absorption rate is as high as 0.5 or more, it is possible to achieve a high sound absorption effect in a low frequency region where the peak frequency is 500 Hz or less. However, there has been a problem that the range of selection of a sound absorbing material is narrow and accordingly it is difficult to achieve the high sound absorption effect in a low frequency region.

Since the sound absorbing material of such a sound absorber completely blocks the through-hole of the frame body, the sound absorbing material does not allow wind or heat to pass therethrough and accordingly heat tends to accumulate on the inside. For this reason, there is a problem that this is not suitable for the sound insulation of equipment and automobiles, which is disclosed in JP4832245B in particular.

In addition, the sound insulation performance of the sound absorber disclosed in JP4832245B changes smoothly according to the usual stiffness law or mass law. For this reason, it has been difficult to effectively use the sound absorber in general equipment and automobiles in which specific frequency components, such as motor sounds, are often strongly generated in a pulsed manner.

In U.S. Pat. No. 7,395,898B (corresponding Japanese Patent Application Publication: JP2005-250474A), the sound attenuation panel can be made very thin and light at low density, can be used at frequencies lower than 500 Hz, can deviate from the law of mass density, and can be easily manufactured at low cost.

However, since the film is specified as an impermeable film, the film does not allow wind or heat to pass therethrough and accordingly heat tends to accumulate on the inside. For this reason, there is a problem that this is not suitable for the sound insulation of equipment and automobiles in particular.

In JP2009-139556A, since it is necessary to use both the sound absorbing action by film vibration and the sound absorbing action by Helmholtz resonance, the rear wall of the partition wall serving as a frame is blocked by the plate-shaped member. Therefore, similarly to JP4832245B, since it is not possible to pass the wind and heat, heat tends to accumulate on the inside. For this reason, there is a problem that the sound absorber is not suitable for sound insulation of equipment, automobiles, and the like.

An object of the present invention is to solve the aforementioned problems of the conventional techniques and provide a soundproof structure which is light and thin, which has air permeability so that wind and heat can pass therethrough and accordingly no heat accumulates on the inside, and which is suitable for equipment, automobiles, and household applications.

In the present invention, "soundproof" includes the meaning of both "sound insulation" and "sound absorption" as acoustic characteristics, but in particular, refers to "sound insulation". "Sound insulation" refers to "shielding sound", that is, "not transmitting sound", and accordingly, includes "reflecting" sound (reflection of sound) and "absorbing" sound (absorption of sound) (refer to Sanseido Daijibin (Third Edition) and http://www.onzai.or.jp/question/soundproof.html and http://www.onzai.or.jp/pdf /new/gijutsu201312_3.pdf on the web page of the Japan Acoustological Materials Society).

Hereinafter, basically, "sound insulation" and "shielding" are referred to in a case where "reflection" and "absorption" are not distinguished from each other, and "reflection" and "absorption" are referred to in a case where "reflection" and "absorption" are distinguished from each other.

As a result of intensive examination to achieve the above object, the present inventors found out that the above problems could be solved as follows, and completed the present invention. One or more soundproof cells are provided. Each soundproof cell includes a frame having a through-hole through which sound passes, a film fixed to the frame, an opening portion configured to include one or more holes drilled in the film, and a weight disposed on the film. The soundproof structure has a first shielding peak frequency, which is determined by the opening portion drilled in the film and at which a transmission loss is maximized, on a lower frequency side than a first natural vibration frequency of the film of each soundproof cell and a second shielding peak frequency, which is determined by the weight and at which a transmission loss is maximized, on a higher frequency side than the first natural vibration frequency of the film, and selectively insulates sound in a predetermined frequency band centered on the first shielding peak frequency and sound in a predetermined frequency band centered on the second shielding peak frequency.

That is, the present invention provides the following soundproof structure.

(1) A soundproof structure comprising one or more soundproof cells. Each of the one or more soundproof cells comprises a frame having a through-hole through which sound passes, a film fixed to the frame, an opening portion configured to include one or more holes drilled in the film, and a weight disposed on the film. The soundproof structure has a first shielding peak frequency, which is determined by the opening portion drilled in the film of each of the one or more soundproof cells and at which a transmission loss is maximized, on a lower frequency side than a first natural vibration frequency of the film of each of the one or more soundproof cells and a second shielding peak frequency, which is determined by the weight and at which a transmission loss is maximized, on a higher frequency side than the first natural vibration frequency of the film, and selectively insulates sound in a predetermined frequency band centered on the first shielding peak frequency and sound in a predetermined frequency band centered on the second shielding peak frequency.

(2) The soundproof structure described in (1) in which the one or more soundproof cells are a plurality of soundproof cells arranged in a two-dimensional manner.

(3) The soundproof structure described in (1) or (2) in which the first natural vibration frequency is determined by a geometric form of the frame of each of the one or more soundproof cells and stiffness of the film of each of the one or more soundproof cells, the first shielding peak frequency is determined according to an area of the opening portion drilled in the film of each of the one or more soundproof cells, and the second shielding peak frequency is determined according to a mass of the weight disposed on the film of each of the one or more soundproof cells.

(4) The soundproof structure described in any one of (1) to (3) in which the first natural vibration frequency is determined by a shape and a size of the frame of each of the one or more soundproof cells and thickness and flexibility of the film of each of the one or more soundproof cells and the first shielding peak frequency is determined according to an average area ratio of the opening portions drilled in the films of the one or more soundproof cells.

(5) The soundproof structure described in any one of (1) to (4) in which the first natural vibration frequency is included in a range of 10 Hz to 100000 Hz.

(6) The soundproof structure described in any one of (1) to (5) in which the opening portion drilled in the film of each of the one or more soundproof cells is formed by one hole.

(7) The soundproof structure described in any one of (1) to (5) in which the opening portion drilled in the film of each of the one or more soundproof cells is formed by a plurality of holes having the same size.

(8) The soundproof structure described in any one of (1) to (7) in which the opening portion is formed so as to pass through the weight.

(9) The soundproof structure described in any one of (1) to (8) in which the weight has a cylindrical shape.

According to the present invention, it is possible to provide a soundproof structure which is light and thin, which has air permeability so that wind and heat can pass therethrough and accordingly no heat accumulates on the inside, and which is suitable for equipment, automobiles, and household applications.

According to the present invention, an arbitrary desired frequency component can be shielded very strongly by providing a very small hole in a film structure and a film portion of the stiffness law shielding structure of the frame.

According to the present invention, large sound insulation can be done near 1000 Hz, which is generally difficult to shield with a thin and light structure even with the mass law and the stiffness law and which is a region that can be heard largely by the human ear.

According to the present invention, since a hole is present, it is possible to realize a structure that shields sound while making a film have air permeability, that is, while allowing wind or heat to pass through the film.

DESCRIPTION OF THE PREFERRED EMBODIMENTS

Hereinafter, a soundproof structure according to the present invention will be described in detail with reference to preferred embodiments shown in the accompanying diagrams.

Figure 1A:
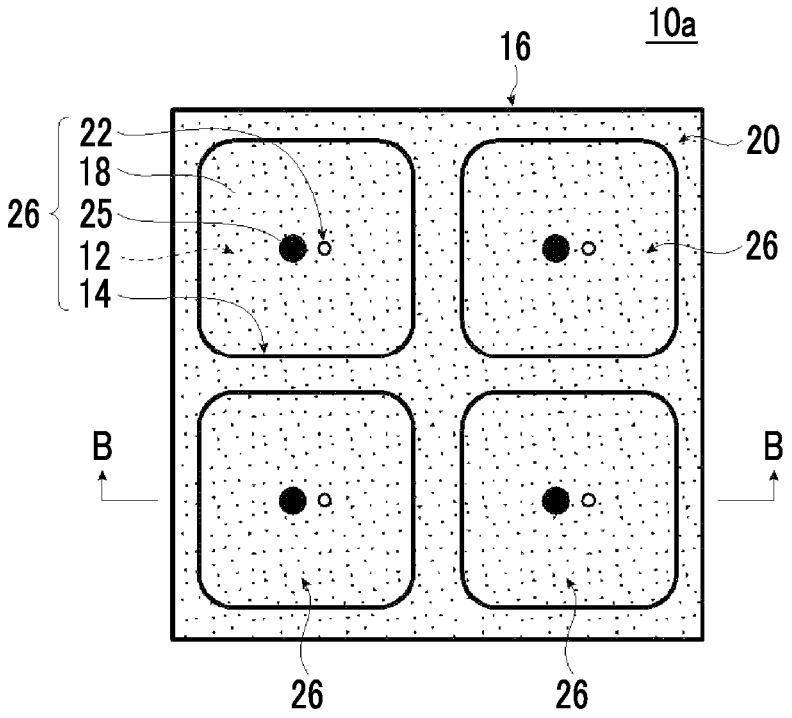
FIG. 1A is a plan view schematically showing an example of a soundproof structure according to the present invention.
Figure 1B:
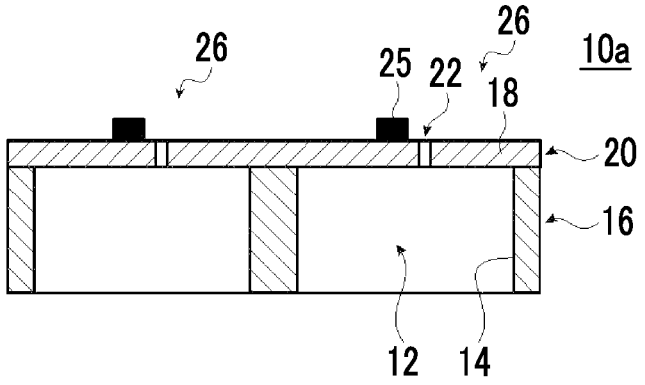
FIG. 1B is a cross-sectional view taken along the line B-B of FIG. 1A.

FIG. 1A is a plan view schematically showing an example of a soundproof structure according to a first embodiment of the present invention, and FIG. 1B is a schematic cross-sectional view taken along the line B-B of FIG. 1A.

A soundproof structure 10*a* of the present invention shown in FIGS. 1A and 1B has: a frame body 16 forming a plurality of frames 14 (in the illustrated example, four frames 14) each of which has a through-hole 12 through which sound passes and which are arranged in a two-dimensional manner; a sheet-shaped film body 20 forming a plurality of films 18 (in the illustrated example, four films 18) which are fixed to the respective frames 14 so as to cover the through-holes 12 of the respective frames 14; a plurality of opening portions 24 (in the illustrated example, four opening portions 24) each of which includes one or more holes 22 (in the illustrated example, one hole 22) drilled so as to penetrate through the film 18 in each frame 14; and one or more weights 25 (in the illustrated example, four weights 25) disposed on the films 18 in the respective frames 14.

In FIG. 1A, in order to describe the configuration of the soundproof structure 10*a*, the structure of the frame 14 is shown to be transmitted through the film 18, and dots are added to the film 18.

In the soundproof structure 10*a*, one frame 14, the film 18 fixed to the frame 14, the opening portion 24 provided in the film 18, and the weight 25 disposed on the film 18 form one soundproof cell 26. Therefore, the soundproof structure 10*a* of the present invention is formed by a plurality of soundproof cells 26 (in the illustrated example, four soundproof cells 26).

Although the soundproof structure 10*a* of the illustrated example is formed by four soundproof cells 26, the present invention is not limited thereto, and may be formed by one soundproof cell 26 configured to include one frame 14, one film 18, one opening portion 24, and one weight 25.

In the case of having a plurality of soundproof cells 26, the plurality of soundproof cells 26 may be arranged in a two-dimensional manner with the surface of the film 18 facing is the same direction. In the illustrated example, four soundproof cells are arranged in 2×2.

Since the frame 14 is formed so as to annularly surround a thick plate-like member, has the through-hole 12 therein-side, and fixes the film 18 so as to cover the through-hole 12 on at least one side, the frame 14 serves as a node of film vibration of the film 18 fixed to the frame 14. Therefore, the frame 14 has higher stiffness than the film 18. Specifically, both the mass and the stiffness of the frame 14 per unit area need to be high.

It is preferable that the shape of the frame 14 has a closed continuous shape capable of fixing the film 18 so as to restrain the entire outer periphery of the film 18. However, the present invention is not limited thereto, and the frame 14 may be made to have a discontinuous shape by cutting a part thereof as long as the frame 14 serves as a node of film vibration of the film 18 fixed to the frame 14. That is, since the role of the frame 14 is to fix the film 18 to control the film vibration, the effect is achieved even if there are small cuts in the frame 14 or even if there are very slightly unbonded parts.

The shape of the through-hole 12 formed by the frame 14 is a planar shape, and is a square in the example shown in FIG. 1. In the present invention, however, the shape of the through-hole 12 is not particularly limited. For example, the shape of the through-hole 12 may be a quadrangle such as a rectangle, a diamond, or a parallelogram, a triangle such as an equilateral triangle, an isosceles triangle, or a right triangle, a polygon including a regular polygon such as a regular pentagon or a regular hexagon, an elliptical shape, and the like, or may be an irregular shape. End portions of the frame 14 on both sides of the opening 12 are not blocked and but are open to the outside as they are. The film 18 is fixed to the frame 14 so as to cover the opening 12 in at least one opened end portion of the opening 12.

The size of the frame 14 is a size in a plan view, and can be defined as the size of the through-hole 12. However, in the case of a regular polygon such as a square shown in FIG. 1A or a circle, the size of the frame 14 can be defined as a distance between opposite sides passing through the center or as a circle equivalent diameter. In the case of a polygon, an ellipse, or an irregular shape, the size of the frame 14 can be defined as a circle equivalent diameter. In the present invention, the circle equivalent diameter and the radius are a diameter and a radius at the time of conversion into circles having the same area.

In the soundproof structure according to the present invention, the size of the frame 14 may be fixed in all frames 14. However, frames having different sizes (including a case where shapes are different) may be included. In this case, the average size of the frames 14 may be used as the size of the frame 14.

The size of the frame 14 is not particularly limited, and may be set according to a soundproofing target to which the soundproof structure of the present invention is applied, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, an air purifier, and a ventilator.

The soundproof structure itself can also be used like a partition in order to shield sound from a plurality of noise sources. Also in this case, the size of the frame 14 can be selected from the frequency of the target noise.

Although the details will be described later, it is preferable to reduce the size of the frame 14 in order to obtain the natural vibration mode of the structure configured to include the frame 14 and the film 18 on the high frequency side.

In addition, although the details will be described later, in order to prevent sound leakage due to diffraction at the shielding peak of the soundproof cell 26 due to the opening portion 24 that is provided in the film 18 and is configured to include holes, it is preferable that the average size of the frame 14 is equal to or less than the wavelength size corresponding to a shielding peak frequency to be described later.

For example, the size of the frame 14 is preferably 0.5 mm to 200 mm, more preferably 1 mm to 100 mm, and most preferably 2 mm to 30 mm.

The size of the frame 14 is preferably expressed by an average size, for example, in a case where different sizes are included in each frame 14.

In addition, the width and the thickness of the frame 14 are not particularly limited as long as the film 18 can be fixed so as to be reliably restrained and accordingly the film 18 can be reliably supported. For example, the width and the thickness of the frame 14 can be set according to the size of the frame 14.

For example, in a case where the size of the frame 14 is 0.5 mm to 50 mm, the width of the frame 14 is preferably 0.5 mm to 20 mm, more preferably 0.7 mm to 10 mm, and most preferably 1 mm to 5 mm.

In a case where the ratio of the width of the frame 14 to the size of the frame 14 is too large, the area ratio of the frame 14 with respect to the entire structure increases. Accordingly, there is a concern that the device will become heavy. On the other hand, in a case where the ratio is too small, it is difficult to strongly fix the film with an adhesive or the like in the frame 14 portion.

In a case where the size of the frame 14 exceeds 50 mm and is equal to or less than 200 mm, the width of the frame 14 is preferably 1 mm to 100 mm, more preferably 3 mm to 50 mm, and most preferably 5 mm to 20 mm.

In addition, the thickness of the frame 14 is preferably 0.5 mm to 200 mm, more preferably 0.7 mm to 100 mm, and most preferably 1 mm to 50 mm.

It is preferable that the width and the thickness of the frame 14 are expressed by an average width and an average thickness, respectively, for example, in a case where different widths and thicknesses are included in each frame 14.

In the present invention, it is preferable that a plurality of frames 14, that is, two or more frames 14 are formed as the frame body 16 arranged so as to be connected in a two-dimensional manner, preferably, as one frame body 16.

Here, the number of frames 14 of the soundproof structure of the present invention, that is, the number of frames 14 forming the frame body 16 in the illustrated example, is not particularly limited. For example, a configuration having nine (3×3) soundproof cells 26, such as a soundproof structure 10*b* shown in FIG. 2, may be adopted, and the number of frames 14 may be set according to the above-described soundproofing target of the soundproof structure of the present invention. Alternatively, since the size of the frame 14 described above is set according to the above-described soundproofing target, the number of frames 14 may be set according to the size of the frame 14.

For example, in the case of in-device noise shielding, the number of frames 14 is preferably 1 to 10000, more preferably 2 to 5000, and most preferably 4 to 1000.

The reason is as follows. For the size of general equipment, the size of the equipment is fixed. Accordingly, in order to make the size of one soundproof cell 26 suitable for the frequency of noise, it is often necessary to perform shielding with the frame body 16 obtained by combining a plurality of soundproof cells 26. In addition, by increasing the number of soundproof cells 26 too much, the total weight is increased by the weight of the frame 14. On the other hand, in a structure such as a partition that is not limited in size, it is possible to freely select the number of frames 14 according to the required overall size.

In addition, since one soundproof cell 26 has one frame 14 as a constitutional unit, the number of frames 14 of the soundproof structure of the present invention can be said to be the number of soundproof cells 26.

The material of the frame 14, that is, the material of the frame body 16, is not particularly limited as long as the material can support the film 18, has a suitable strength in the case of being applied to the above soundproofing target, and is resistant to the soundproof environment of the soundproofing target, and can be selected according to the soundproofing target and the soundproof environment. For example, as materials of the frame 14, metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, and glass fiber reinforced plastics (GFRP) can be mentioned. A plurality of materials of the frame 14 may be used in combination.

Since the film 18 is fixed so as to be restrained by the frame 14 so as to cover the through-hole 12 inside the frame 14, the film 18 vibrates in response to sound waves from the outside. By absorbing or reflecting the energy of sound waves, the sound is insulated. For this reason, it is preferable that the film 18 is impermeable to air.

Incidentally, since the film 18 needs to vibrate with the frame 14 as a node, it is necessary that the film 18 is fixed to the frame 14 so as to be reliably restrained by the frame 14 and accordingly becomes an antinode of film vibration, thereby absorbing or reflecting the energy of sound waves to insulate sound. For this reason, it is preferable that the film 18 is formed of a flexible elastic material.

Therefore, the shape of the film 18 is the shape of the through-hole 12 of the frame 14. In addition, the size of the film 18 is the size of the frame 14. More specifically, the size of the film 18 can be said to be the size of the through-hole 12 of the frame 14.

Here, the film 18 fixed to the frame 14 of the soundproof cell 26 has a first natural vibration frequency at which the transmission loss is the minimum, for example 0 dB, as a resonance frequency that is a frequency of the lowest order natural vibration mode. That is, in the present invention, sound is transmitted at the first natural vibration frequency of the film 18. In the present invention, the first natural vibration frequency is determined by the structure configured to include the frame 14 and the film 18. Therefore, the present inventors have found that the first natural vibration frequency becomes approximately the same value regardless of the presence or absence of the hole 22 (opening portion 24) drilled in the film 18 and the weight 25 (refer to FIGS. 5A to 8).

Here, the first natural vibration frequency of the film 18, which is fixed so as to be restrained by the frame 14, in the structure configured to include the frame 14 and the film 18 is the frequency of the natural vibration mode at which the sound wave most vibrates the film vibration due to the resonance phenomenon. The sound wave is largely transmitted at the frequency.

According to the finding of the present inventors, in the soundproof structure of the present invention, the hole 22 forming the opening portion 24 is drilled in the film 18 as a through-hole. Therefore, a shielding peak of the sound wave whose transmission loss is a peak (maximum) appears at the first shielding peak frequency on the lower frequency side than the first natural vibration frequency.

In the soundproof structure of the present invention, since the weight 25 is disposed on the film 18, a shielding peak of the sound wave whose transmission loss is a peak (maximum) appears at the second shielding peak frequency on the higher frequency side than the first natural vibration frequency.

Accordingly, in the soundproof structure of the present invention, the shielding (transmission loss) becomes a peak (maximum) at the first shielding peak frequency and the second shielding peak frequency. As a result, it is possible to selectively insulate sound in a predetermined frequency band centered on the first shielding peak frequency and sound in a predetermined frequency band centered on the second shielding peak frequency.

For example, in the graph of FIG. 5 that is the measurement result of the transmission loss of the soundproof structure of Example 1 to be described later, the first natural vibration frequency is about 510 Hz in the audible range, and a shielding peak at which the value of transmission loss is a peak value appears at about 450 Hz that is the first shielding peak frequency on the lower frequency side than the first natural vibration frequency. In addition, a shielding peak at which the value of transmission loss is a peak value appears at about 1336 Hz that is the second shielding peak frequency on the higher frequency side than the first natural vibration frequency.

Therefore, it is possible to selectively insulate sound in a predetermined frequency band centered on about 450 Hz in the audible range and sound in a predetermined frequency band centered on about 1336 Hz.

Figure 6:
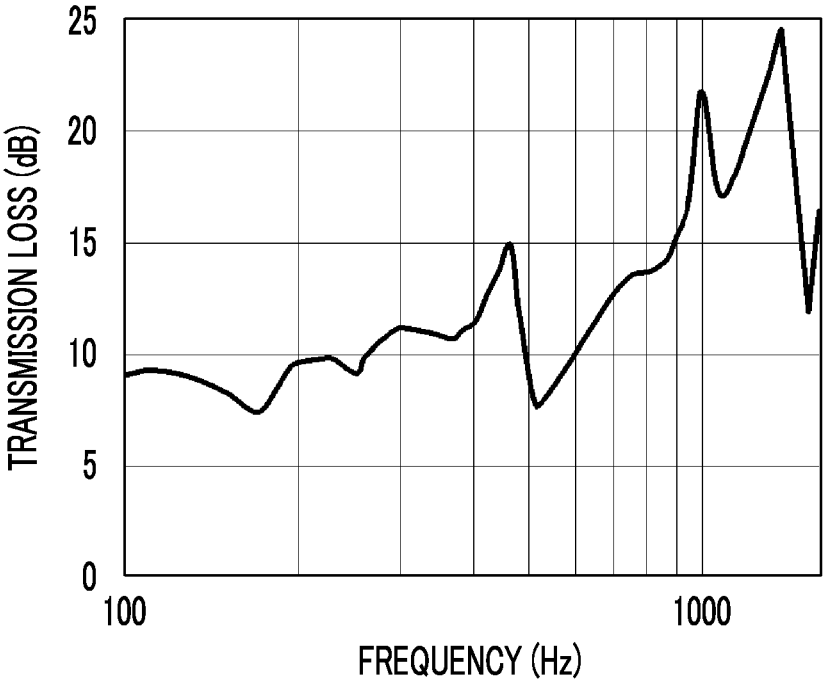
FIG. 6 is a graph showing the relationship between a frequency and a transmission loss in a soundproof structure of Example 2.
Figure 7:
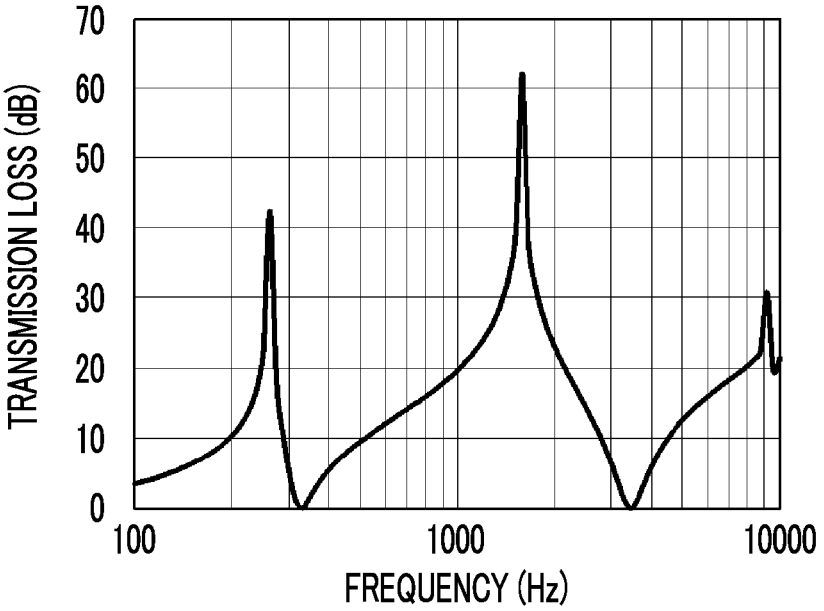
FIG. 7 is a graph showing the relationship between a frequency and a transmission loss in a soundproof structure of Example 3.

Also in each of examples shown in FIGS. 6 and 7, similarly, the first shielding peak frequency on the lower frequency side than the first natural vibration frequency and the second shielding peak frequency on the higher frequency side than the first natural vibration frequency are shown. Therefore, this shows that it is possible to selectively insulate sound in a predetermined frequency band centered on the first shielding peak frequency and sound in a predetermined frequency band centered on the second shielding peak frequency.

In addition, a method of measuring the transmission loss (dB) in the soundproof structure of the present invention will be described later.

Therefore, in the structure configured to include the frame 14 and the film 18, in order to set the first shielding peak frequency depending on the opening portion 24 configured to include one or more holes 22 to an arbitrary frequency within the audible range and set the second shielding peak frequency depending on the weight 25 to an arbitrary frequency within the audible range, it is important to obtain the natural vibration mode within the audible range. In particular, this is practically important. Therefore, the thickness of the film 18, the Young's modulus of the material of the film 18, the size of the frame 14, and the like may be appropriately set according to the frequency of sound to be shielded by the soundproofing target described above. For example, in a case where the first natural vibration frequency is set to a higher frequency, it is preferable to make the film 18 thick, increase the Young's modulus of the material of the film 18, and reduce the size of the frame 14, that is, the size of the film 18.

Here, since the soundproof structure of the present invention complies with the stiffness law. In order to shield sound waves at a frequency lower than the first natural vibration frequency of the film 18 fixed to the frame 14 and a frequency higher than the first natural vibration frequency of the film 18, the first natural vibration frequency of the film 18 is preferably 10 Hz to 100000 Hz corresponding to the sound wave sensing range of a human being, more preferably 20 Hz to 20000 Hz that is the audible range of sound waves of a human being, even more preferably 40 Hz to 16000 Hz, most preferably 100 Hz to 12000 Hz.

The thickness of the film 18 is not particularly limited as long as the film can vibrate by absorbing or reflecting the energy of sound waves to insulate sound. In the present invention, for example, the thickness of the film 18 can be set according to the size of the frame 14, that is, the size of the film.

For example, in a case where the size of the frame 14 is 0.5 mm to 50 mm, the thickness of the film 18 is preferably 0.005 mm (5 μm) to 5 mm, more preferably 0.007 mm (7 μm) to 2 mm, and most preferably 0.01 mm (10 μm) to 1 mm.

In a case where the size of the frame 14 exceeds 50 mm and is equal to or less than 200 mm, the thickness of the film 18 is preferably 0.01 mm (10 μm) to 20 mm, more preferably 0.02 mm (20 μm) to 10 mm, and most preferably 0.05 mm (50 μm) to 5 mm.

The thickness of the film 18 is preferably expressed by an average thickness, for example, in a case where the thickness of one film 18 is different or in a case where different thicknesses are included in each film 18.

In the soundproof structure of the present invention, the first natural vibration frequency of the film 18 in the structure configured to include the frame 14 and the film 18 can be determined by the geometric form of the frame 14 of a plurality of soundproof cells 26, for example, the shape and size of the frame 14, and the stiffness of the film of the plurality of soundproof cells, for example, thickness and flexibility of the film.

As a parameter characterizing the first natural vibration mode of the film 18, in the case of the film 18 of the same material, a ratio between the thickness (t) of the film 18 and the square of the size (a) of the frame 14 can be used. For example, in the case of a square, a ratio $[a^2/t]$ between the size of one side and the square (t) of the size (a) of the frame 14 can be used. In a case where the ratio $[a^2/t]$ is the same, for example, in a case where (t, a) is (50 μm, 7.5 mm) and a case where (t, a) is (200 μm, 15 mm), the first natural vibration mode is the same frequency, that is, the same first natural vibration frequency. That is, by setting the ratio $[a^2/t]$ to a fixed value, the scale law is established. Accordingly, an appropriate size can be selected.

The Young's modulus of the film 18 is not particularly limited as long as the film 18 has elasticity capable of performing film vibration in order to insulate sound by absorbing or reflecting the energy of sound waves.

For example, the Young's modulus of the film 18 can be set according to the size of the frame 14, that is, the size of the film in the present invention. For example, the Young's modulus of the film 18 is preferably 1000 Pa to 3000 GPa, more preferably 10000 Pa to 2000 GPa, and most preferably 1 MPa to 1000 GPa.

The density of the film 18 is not particularly limited either as long as the film can vibrate by absorbing or reflecting the energy of sound waves to insulate sound. For example, the density of the film 18 is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

In a case where a film-shaped material or a foil-shaped material is used as a material of the film 18, the material of the film 18 is not particularly limited as long as the material has a strength in the case of being applied to the above soundproofing target and is resistant to the soundproof environment of the soundproofing target so that the film 18 can vibrate by absorbing or reflecting the energy of sound waves to insulate sound, and can be selected according to the soundproofing target, the soundproof environment, and the like. Examples of the material of the film 18 include resin materials that can be made into a film shape such as polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene, metal materials that can be made into a foil shape such as aluminum, chromium, titanium, stainless steel, nickel, tin, niobium, tantalum, molybdenum, zirconium, gold, silver, platinum, palladium, iron, copper, and permalloy, fibrous materials such as paper and cellulose, and materials or structures capable of forming a thin structure such as a nonwoven fabric, a film containing nano-sized fiber, porous materials including thinly processed urethane or synthrate, and carbon materials processed into a thin film structure.

The film 18 may be individually fixed to each of the plurality of frames 14 of the frame body 16 of the soundproof structure 10*a* to form the sheet-shaped film body 20 as a whole. Conversely, each film 18 covering each frame 14 may be formed by one sheet-shaped film body 20 fixed so as to cover all the frames 14. That is, a plurality of films 18 may be formed by one sheet-shaped film body 20 covering a plurality of frames 14. Alternatively, the film 18 covering each frame 14 may be formed by fixing a sheet-shaped film body to a part of the frame 14 so as to cover some of the plurality of frames 14, and the sheet-shaped film body 20 covering all of the plurality of frames 14 (all frames 14) may be formed by using some of these sheet-shaped frame bodies.

In addition, the film 18 is fixed to the frame 14 so as to cover an opening on at least one side of the through-hole 12 of the frame 14. That is, the film 18 may be fixed to the frame 14 so as to cover openings on one side, the other side, or both sides of the through-hole 12 of the frame 14.

Here, all the films 18 may be provided on the same side of the through-holes 12 of the plurality of frames 14 of the soundproof structure 10*a*. Alternatively, some of the films 18 may be provided on one side of each of some of the through-holes 12 of the plurality of frames 14, and the remaining films 18 may be provided on the other side of each of the remaining some through-holes 12 of the plurality of frames 14. Furthermore, films provided on one side, the other side, and both sides of the through-holes 12 of the frame 14 may be mixed.

The method of fixing the film 18 to the frame 14 is not particularly limited. Any method may be used as long as the film 18 can be fixed to the frame 14 so as to serve as a node of film vibration. For example, a method using an adhesive, a method using a physical fixture, and the like can be mentioned.

In the method of using an adhesive, an adhesive is applied onto the surface of the frame 14 surrounding the through-hole 12 and the film 18 is placed thereon, so that the film 18 is fixed to the frame 14 with the adhesive. Examples of the adhesive include epoxy-based adhesives (Araldite (registered trademark) (manufactured by Nichiban Co., Ltd.) and the like), cyanoacrylate-based adhesives (Aron Alpha (registered trademark) (manufactured by Toagosei Co., Ltd.) and the like), and acrylic-based adhesives.

As a method using a physical fixture, a method can be mentioned in which the film 18 disposed so as to cover the through-hole 12 of the frame 14 is interposed between the frame 14 and a fixing member, such as a rod, and the fixing member is fixed to the frame 14 by using a fixture, such as a screw.

In the film 18, that is, in the soundproof cell 26, the opening portion 24 configured to include one or more holes 22 is provided.

Here, as described above, in the soundproof structure of the present invention, by providing the opening portion 24 configured to include one or more holes 22 drilled in the film 18, a peak of transmission loss at which shielding is a peak (maximum) is provided on the lower frequency side than the first natural vibration frequency of the film 18. The frequency at which shielding (transmission loss) is a peak (maximum) is referred to as a first shielding peak frequency.

The first shielding peak frequency appears due to the opening portion 24 on the lower frequency side than the first natural vibration frequency that mainly depends on the film 18 of the soundproof cell 26 of the soundproof structure 10. The first shielding peak frequency is determined according to the size of the opening portion 24 with respect to the size of the frame 14 (or the film 18), specifically, the opening ratio of the opening portion 24 that is the ratio of the total area of the hole 22 to the area of the through-hole 12 (or the film 18 that covers the through-hole 12) of the frame 14.

Here, one or more holes 22 may be drilled in the film 18 that covers the through-hole 12 of the soundproof cell 26. The drilling position of the hole 22 may be the middle of the soundproof cell 26 or the film 18 (hereinafter, represented by the soundproof cell 26). However, the present invention is not limited thereto, the drilling position of the hole 22 does not need to be the middle of the soundproof cell 26, and the hole 22 may be drilled at any position.

That is, simply by changing the drilling position of the hole 22, the first shielding peak frequency is not changed, and the sound insulation characteristics of the soundproof structure 10 of the present invention are not changed.

In the present invention, however, it is preferable that the hole 22 is drilled in a region within a range away from the fixed end of the peripheral portion of the through-hole 12 more than 20% of the size of the surface of the film 18. Most preferably, the hole 22 is provided at the center of the film 18.

Figure 4A:
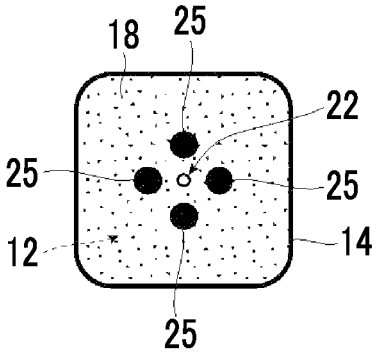
FIG. 4A is a plan view schematically showing another example of the soundproof cell of the soundproof structure of the present invention.
Figure 4B:
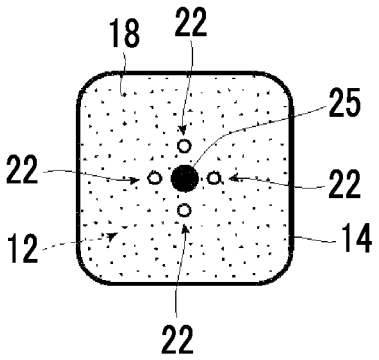
FIG. 4B is a plan view schematically showing another example of the soundproof cell of the soundproof structure of the present invention.

The number of holes 22 forming the opening portion 24 in the soundproof cell 26 may be one for one soundproof cell 26. However, the present invention is not limited thereto, and two or more (that is, a plurality of) holes 22 may be provided as shown in FIG. 4B.

Here, in the soundproof structure 10 of the present invention, from the viewpoint of air permeability, it is preferable that the opening portion 24 of each soundproof cell 26 is formed as one hole 22. The reason is that, in the case of a fixed opening ratio, the easiness of passage of air as wind is large in a case where one hole is large and the viscosity at the boundary does not work greatly.

On the other hand, when there is a plurality of holes 22 in one soundproof cell 26, the sound insulation characteristic of the soundproof structure 10 of the present invention indicates a sound insulation characteristic corresponding to the total area of the plurality of holes 22, that is, the area of the opening portion 24. That is, the sound insulation characteristic of the soundproof structure 10 of the present invention indicates a corresponding shielding peak at the corresponding shielding peak frequency. Therefore, it is preferable that the area of the opening portion 24, which is the total area of the plurality of holes 22 in one soundproof cell 26 (or the film 18) is equal to the area of the opening portion 24, which is the area of one hole 22 that is only provided in another soundproof cell 26 (or the film 18). However, the present invention is not limited thereto.

In a case where the opening ratio of the opening portion 24 in the soundproof cell 26 (the area ratio of the opening portion 24 to the area of the film 18 covering the through-hole 12 (the ratio of the total area of all the holes 22)) is the same, the same soundproof structure 10 is obtained with the single hole 22 and the plurality of holes 22. Accordingly, even if the size of the hole 22 is fixed to any size, it is possible to manufacture soundproof structures corresponding to various frequency bands.

In the present invention, the opening ratio (area ratio) of the opening portion 24 in the soundproof cell 26 is not particularly limited, and may be set according to the sound insulation frequency band to be selectively insulated. The opening ratio (area ratio) of the opening portion 24 in the soundproof cell 26 is preferably 0.000001% to 70%, more preferably 0.000005% to 50%, and most preferably 0.00001% to 30%. By setting the opening ratio of the opening portion 24 within the above range, it is possible to determine the first shielding peak frequency, which is the center of the sound insulation frequency band to be selectively insulated, and the transmission loss at the shielding peak.

From the viewpoint of manufacturing suitability, it is preferable that the soundproof structure 10 of the present invention has a plurality of holes 22 of the same size in one soundproof cell 26. That is, it is preferable that the opening portion 24 of soundproof cell 26 is configured to include a plurality of holes 22 of the same size.

In addition, in the soundproof structure 10 of the present invention, it is preferable that the holes 22 forming the opening portions 24 of all the soundproof cells 26 have the same size.

In the present invention, it is preferable that the hole 22 is drilled using a processing method for absorbing energy, for example, laser processing, or it is preferable that the hole 22 is drilled using a mechanical processing method based on physical contact, for example, punching or needle processing.

Therefore, in a case where a plurality of holes 22 in one soundproof cell 26 or one or a plurality of holes 22 in all the soundproof cells 26 are made to have the same size, in the case of drilling holes by laser processing, punching, or needle processing, it is possible to continuously drill holes without changing the setting of a processing apparatus or the processing strength.

In addition, in the soundproof structure 10 of the present invention, the size of the hole 22 in the soundproof cell 26 (or the film 18) may be different for each soundproof cell 26 (or the film 18). In a case where there are holes 22 having different sizes for each soundproof cell 26 (or the film 18) as described above, a sound insulation characteristic corresponding to the average area of the areas of the holes 22, that is, a corresponding first shielding peak at the corresponding shielding peak frequency is shown.

In addition, it is preferable that 70% or more of the opening portion 24 of each soundproof cell 26 of the soundproof structure 10 of the present invention is formed by holes having the same size.

The size of the hole 22 forming the opening portion 24 may be any size as long as the hole 22 can be appropriately drilled by the above-described processing method, and is not particularly limited.

However, from the viewpoint of processing accuracy of laser processing such as accuracy of laser diaphragm, processing accuracy of punching or needle processing, manufacturing suitability such as easiness of processing, and the like, the size of the hole 22 on the lower limit side thereof is preferably 2 μm or more, more preferably 5 μm or more, and most preferably 10 μm or more.

The upper limit of the size of the hole 22 needs to be smaller than the size of the frame 14. Therefore, normally, in a case where the size of the frame 14 is set to the order of mm and the size of the hole 22 is set to the order of μm, the upper limit of the size of the hole 22 does not exceed the size of the frame 14. In a case where the upper limit of the size of the hole 22 exceeds the size of the frame 14, the upper limit of the size of the hole 22 may be set to be equal to or less than the size of the frame 14.

The soundproof cell 26 has one or more weights 25 disposed on the film 18.

Here, as described above, in the soundproof structure of the present invention, by providing the weight 25 disposed on the film 18, a peak of transmission loss at which shielding is a peak (maximum) is provided on the higher frequency side than the first natural vibration frequency of the film 18. The frequency at which shielding (transmission loss) is a peak (maximum) is referred to as a second shielding peak frequency.

The second shielding peak frequency appears due to the weight 25 on the higher frequency side than the first natural vibration frequency that mainly depends on the film 18 of the soundproof cell 26 of the soundproof structure 10. The second shielding peak frequency is determined according to the weight of the weight 25, specifically, and the weight of the weight 25 and the stiffness of the film 18.

Here, one or more weights 25 may be disposed on the film 18 that covers the through-hole 12 of the soundproof cell 26. The arrangement position of the weight 25 may be the middle of the soundproof cell 26 (film 18). However, the present invention is not limited thereto, the arrangement position of the weight 25 does not need to be the middle of the soundproof cell 26, and the weight 25 may be disposed at any position.

In the example shown in FIG. 1B, the weight 25 is disposed on the front side of the film 18 (surface on a side opposite to the frame 14). However, the present invention is not limited thereto, and the weight 25 may be disposed on the back side of the film 18, that is, in the through-hole 12 of the frame 14. Alternatively, the weight 25 may be disposed on both sides of the film 18.

The number of weights 25 in the soundproof cell 26 may be one for one soundproof cell 26. However, the present invention is not limited thereto, and two or more (that is, a plurality of) weights 25 may be provided as shown in FIG. 4A.

In the present invention, the weight of the weight 25 in the soundproof cell 26 is not particularly limited, and may be set according to the sound insulation frequency band to be selectively insulated. The weight of the weight 25 in the soundproof cell 26 is preferably 0.01 g to 10 g, more preferably 0.1 g to 1 g. By setting the weight of the weight 25 within the above range, it is possible to determine the second shielding peak frequency, which is the center of the sound insulation frequency band to be selectively insulated, and the transmission loss at the shielding peak.

The shape of the weight 25 is not particularly limited either, and can be various shapes, such as a plate shape, a column shape, and a cylindrical shape.

Here, from the viewpoint of not inhibiting the vibration of the film 18, the ratio of the area of the weight 25 to the area of the film 18 in plan view is preferably 50% or less, more preferably 10% or less.

The material of the weight 25 is not particularly limited, and can be selected according to the soundproofing target described above, its soundproof environment, and the like.

Specifically, metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose, magnetic materials such as ferrite magnets and neodymium magnets, carbon fiber reinforced plastic (CFRP), carbon fiber, and glass fiber reinforced plastic (GFRP) can be mentioned.

Here, as described above, it is preferable that the ratio of the area of the weight 25 to the area of the film 18 is as small as possible, and it is desirable that the weight 25 has a sufficient weight within a predetermined range. Therefore, as the material of the weight 25, it is preferable to use a material having a high density. From this point, it is more preferable that the material of the weight 25 is a metal such as iron or steel.

In the present invention, a method of fixing the weight 25 to the film 18 is not particularly limited. For example, a method using an adhesive, a method using a double-sided tape, and the like can be mentioned. Examples of the adhesive include epoxy-based adhesives (Araldite and the like), cyanoacrylate-based adhesives (Aron Alpha and the like), acrylic-based adhesives, and the like.

In the soundproof structure 10 of the present invention, the weight of the weight 25 of the soundproof cell 26 may be different for each soundproof cell 26. In a case where there are weights 25 having different weights for each soundproof cell 26 as described above, sound insulation characteristics corresponding to the average value obtained by averaging the weights of the weights 25, that is, a corresponding shielding peak at the corresponding second shielding peak frequency is shown.

It is preferable that 70% or more of the weights 25 of the respective soundproof cells 26 of the soundproof structure 10 of the present invention are weights having the same weight.

Since the soundproof structure of the present invention is configured as described above, the soundproof structure of the present invention has features that it is possible to perform low frequency shielding, which has been difficult in conventional soundproof structures, and that it is possible to design a structure capable of strongly insulating noise of various frequencies from low frequencies to frequencies exceeding 1000 Hz. In addition, since the soundproof structure of the present invention is configured to have two shielding peaks, the soundproof structure of the present invention can also be used to shield sound from a plurality of noise sources.

In addition, since the soundproof structure of the present invention is based on the sound insulation principle independent of the mass of the structure (mass law), it is possible to realize a very light and thin sound insulation structure compared with conventional soundproof structures. Therefore, the soundproof structure of the present invention can also be applied to a soundproofing target from which it has been difficult to sufficiently insulate sound with the conventional soundproof structures.

Since the soundproof structure of the present invention has holes, is possible to realize a structure that shields sound while making a film have air permeability, that is, while allowing wind or heat to pass through the film.

In the soundproof structure of the present invention, the opening portion 24 (hole 22) of the soundproof cell 26 may be covered with a member through which sound can pass as an acoustic wave.

For the sound insulation of the soundproof structure of the present invention, it is important that both the opening portion 24 (hole 22), through which sound can pass not as film vibration but as an acoustic wave, and the film 18 through which sound passes as film vibration. Therefore, even in a state in which an opening portion through which sound can pass is covered with a member, through which sound can pass not as film vibration but as an acoustic wave transmitted through the air, it is possible to obtain a peak of sound insulation similarly to a case where the opening portion is open. Such a member is a generally air-permeable member.

As a representative example of such a member having air permeability, a mesh net can be mentioned. As an example, an Amidology 30 mesh product manufactured by NBC Meshtec Inc. can be mentioned. However, the present inventors have confirmed that even if the opening portion 24 is closed by this, the obtained spectrum does not change.

The net may have a lattice form or a triangular lattice form. In particular, since the net does not depend on its shape, there is no limitation on the net.

The size of the entire net may be a size covering the opening portion 24 of each soundproof cell 26, and may be larger or smaller than the size of the frame body of the present invention.

In addition, the net may be a net whose mesh has a size intended for so-called insect repelling, or may be a net that prevents the entry of more fine sand. The material may be a net formed of a synthetic resin, or may be a wire for crime prevention or radio wave shielding.

A plurality of nets may be disposed for each soundproof cell so as to cover the opening portion 24 of each soundproof cell 26, or one net covering the entire frame body may be disposed so as to cover all the opening portions 24 of each soundproof cell 26.

The arrangement position of the net is not particularly limited, and may be disposed on the film 18 as long as it is possible to cover the opening portion 24, or may be disposed on a surface of the frame body 16 opposite to a surface on which the film 18 is disposed.

In addition, the above-described permeable member is not limited to the mesh net. In addition to the net, a nonwoven fabric material, a urethane material, Synthrate (manufactured by 3M Company), Breath Air (manufactured by Toyobo Co., Ltd.), Dot Air (manufactured by Toray Industries, Inc.), and the like can be mentioned. In the present invention, by covering the through-hole 22 with such a material having air permeability, it is possible to prevent insects or sand from passing through the hole, to ensure the privacy such that the inside cannot be seen through the hole portion, and to ensure hiding.

The soundproof structure of the present invention is manufactured as follows.

First, the frame body 16 having a plurality of frames 14 and the sheet-shaped film body 20 covering all the through-holes 12 of all the frames 14 of the frame body 16 are prepared.

Then, the sheet-shaped film body 20 is fixed to all the frames 14 of the frame body 16 with an adhesive to form the film 18 that covers the through-holes 12 of all the frames 14, thereby forming a plurality of soundproof cells having a structure configured to include the frame 14 and the film 18.

Then, one or more holes 22 are drilled in the film 18 of each of the plurality of soundproof cells using a processing method for absorbing energy, such as laser processing, or a mechanical processing method based on physical contact, such as punching or needle processing, thereby forming the opening portion 24 in each soundproof cell 26.

Then, by fixing the weight 25 to each film 18 of a plurality of soundproof cells using an adhesive, a double-sided tape, or the like, a plurality of soundproof cells each having the frame 14, the film 18, the opening portion 24, and the weight 25 are formed.

In this manner, it is possible to manufacture the soundproof structure of the present invention. The order of the step of processing the hole 22 and the step of fixing the weight 25 is not limited, and the hole 22 may be formed after fixing the weight 25.

Here, in the example shown in FIG. 1A, the opening portion 24 (hole 22) and the weight 25 are independently provided on the film 18. However, the present invention is not limited thereto.

Figure 3A:
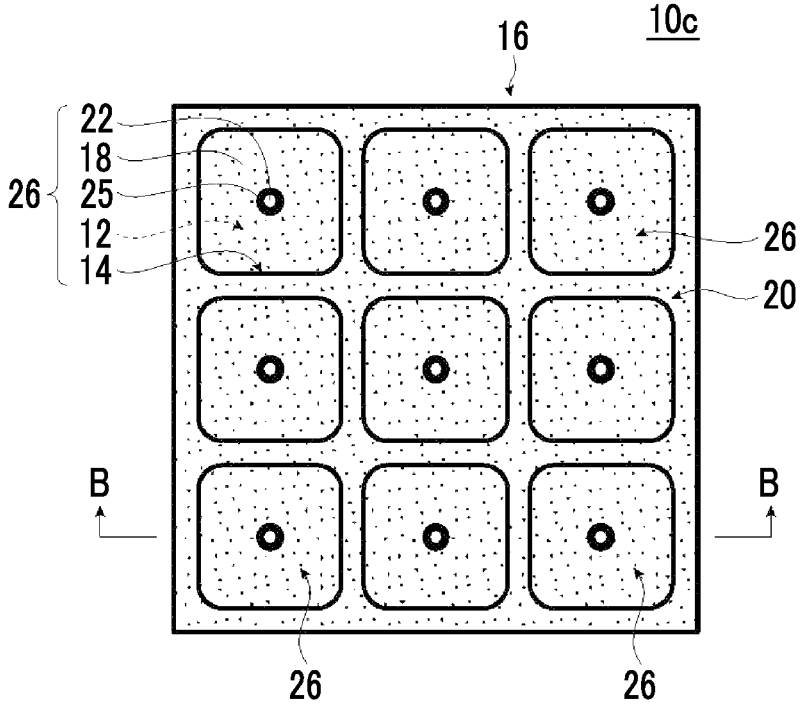
FIG. 3A is a plan view schematically showing another example of the soundproof structure according to the present invention.
Figure 3B:
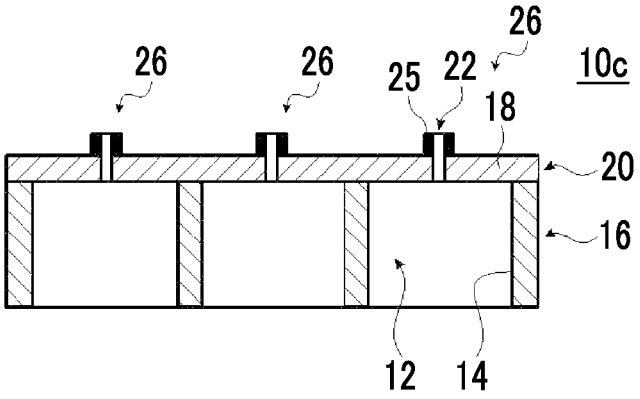
FIG. 3B is a cross-sectional view taken along the line B-B of FIG. 3A.

FIG. 3A shows a plan view of another example of the soundproof structure of the present invention, and FIG. 3B shows a cross-sectional view taken along the line B-B of FIG. 3A.

A soundproof structure 10*c* shown in FIGS. 3A and 3B has nine soundproof cells 26 arranged in 3×3.

Each soundproof cell 26 has the frame 14 having the through-hole 12, the film 18 fixed so as to cover the through-hole 12 of the frame 14, the weight 25 disposed on the film 18, and the hole 22 passing through the weight 25 and the film 18.

In other words, the weight 25 has a cylindrical shape, and the weight 25 and the hole 22 are disposed so as to overlap each other by aligning the central axis of a hollow portion of the cylinder with the central axis of the hole 22.

Thus, the weight 25 may be provided in the hole 22 (opening portion 24).

As described above, the number of holes 22 drilled in the film 18 is not particularly limited, and the number of weights 25 disposed on the film 18 is not particularly limited either. In addition, the number of holes 22 and the number of weights 25 may be the same or different.

For example, as shown in FIG. 4A, a configuration having one hole 22 drilled at the center of the film 18 and four weights 25 disposed around the hole 22 may be adopted. Alternatively, as shown in FIG. 4B, a configuration having one weight 25 disposed at the center of the film 18 and four holes 22 drilled around the weight 25 may be adopted.

Hereinafter, the physical properties or characteristics of a structural member that can be combined with a soundproof member having the soundproof structure of the present invention will be described.

[Flame Retardancy]

In the case of using a soundproof member having the soundproof structure of the present invention as a soundproof material in a building or a device, flame retardancy is required.

Therefore, the film is preferably flame retardant. As the film, for example, Lumirror (registered trademark) nonhalogen flame-retardant type ZV series (manufactured by Toray Industries, Inc.) that is a flame-retardant PET film, Teijin Tetoron (registered trademark) UF (manufactured by Teijin Ltd.), and/or Dialamy (registered trademark) (manufactured by Mitsubishi Plastics Co., Ltd.) that is a flame-retardant polyester film may be used.

The frame is also preferably a flame-retardant material. A metal such as aluminum, an inorganic material such as semilac, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the film to the frame, a bonding method using a flame-retardant adhesive (Three Bond 1537 series (manufactured by Three Bond Co. Ltd.)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray Industries, Inc.) are preferably used. In general, it is preferable to use a metal film, such as aluminum having a smaller coefficient of thermal expansion than a plastic material.

As the frame, it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to a film or a frame, it is preferable to set the thickness to 1 μm or less so that the amount of expansion and contraction can be reduced.

[Weather Resistance and Light Resistance]

In a case where the soundproof member having the soundproof structure of the present invention is disposed outdoors or in a place where light is incident, the weather resistance of the structural member becomes a problem.

Therefore, as a film, it is preferable to use a weather-resistant film, such as a special polyolefin film (ARTPLY (trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As a frame member, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International). Regarding moisture resistance as well, it is preferable to appropriately select a film, a frame, and an adhesive having high moisture resistance.

Regarding water absorption and chemical resistance, it is preferable to appropriately select an appropriate film, frame, and adhesive.

[Dust]

During long-term use, dust may adhere to the film surface to affect the soundproofing characteristics of the soundproof structure of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK Corporation) and/or NCF (Nagaoka Sangyou Co., Ltd.)) so that the film is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.)). By using a photocatalytic film (Raceline (manufactured by Kimoto Corporation)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

Figure 9:
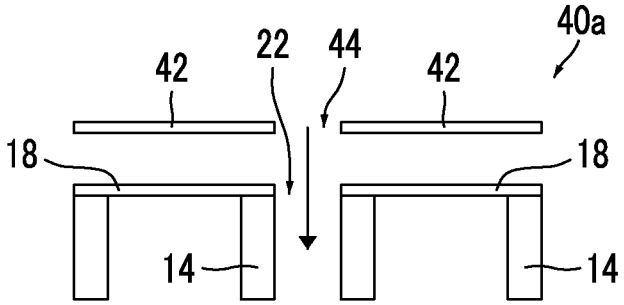
FIG. 9 is a schematic cross-sectional view of an example of a soundproof member having the soundproof structure of the present invention.
Figure 10:
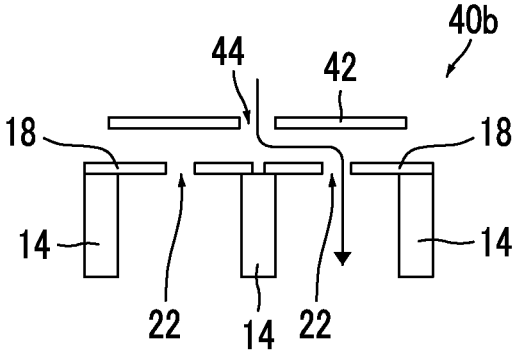
FIG. 10 is a schematic cross-sectional view of another example of the soundproof member having the soundproof structure of the present invention.

In the soundproof structure having a through-hole serving as a ventilation hole in the film, as in soundproof members 40*a* and 40*b* shown in FIGS. 9 and 10, it is preferable to perform arrangement by drilling the holes 44 in the cover 42 provided on the film 18 so that wind or dust is not in direct contact with the film 18.

As a method of removing adhering dust, it is possible to remove dust by emitting sound having the resonance frequency of a film and strongly vibrating the film. The same effect can be obtained even if a blower or wiping is used.

[Wind Pressure]

In a case where a strong wind hits a film, the film may be pressed to change the resonance frequency. Therefore, by covering the film with a nonwoven fabric, urethane, and/or a film, the influence of wind can be suppressed. In the soundproof structure having a through-hole in the film, similarly to the case of dust described above, as in the soundproof members 40*a* and 40*b* shown in FIGS. 9 and 10, it is preferable to perform arrangement by drilling the holes 44 in the cover 42 provided on the film 18 so that wind is not in direct contact with the film 18.

[Combination of Unit Cells]

The soundproof structure of the present invention is formed by one frame body 16 in which a plurality of frames 14 are continuous. However, the present invention is not limited thereto, and a soundproof cell as a unit cell having one frame and one film attached to the frame or as a unit cell having the one frame, the one film, and a through-hole formed in the film. That is, the soundproof member having the soundproof structure of the present invention does not necessarily need to be formed by one continuous frame body, and a soundproof cell having a frame structure as a unit cell and a film structure attached thereto or a soundproof cell having one frame structure, one film structure, and a hole structure formed in the film structure may be used. Such a unit cell can be used independently, or a plurality of unit cells can be connected and used.

As a method of connecting a plurality of unit cells, as will be described later, a Magic Tape (registered trademark), a magnet, a button, a suction cup, and/or an uneven portion may be attached to a frame body portion so as to be combined therewith, or a plurality of unit cells can be connected using a tape or the like.

[Arrangement]

Figure 11:
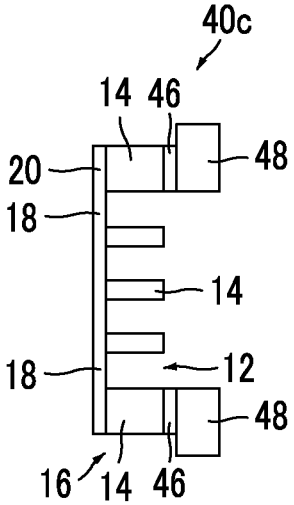
FIG. 11 is a schematic cross-sectional view showing an example of a state in which a soundproof member having the soundproof structure of the present invention is attached to the wall.
Figure 12:
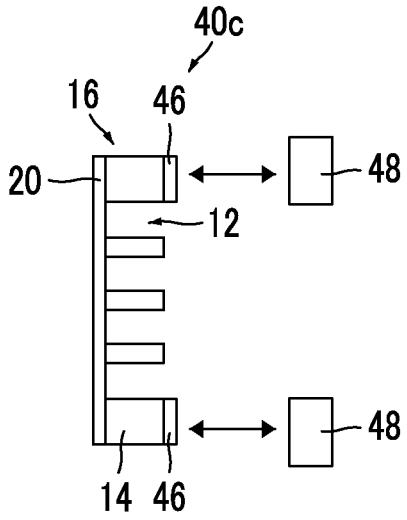
FIG. 12 is a schematic cross-sectional view of an example of a state in which the soundproof member shown in FIG. 11 is detached from the wall.

In order to allow the soundproof member having the soundproof structure of the present invention to be easily attached to a wall or the like or to be removable therefrom, a detaching mechanism formed of a magnetic material, a Magic Tape (registered trademark), a button, a suction cup, or the like is preferably attached to the soundproof member. For example, as shown in FIG. 11, a detaching mechanism 46 may be attached to the bottom surface of the frame 14 on the outer side of the frame body 16 of a soundproof member 40*c*, and the detaching mechanism 46 attached to the soundproof member 40*c* may be attached to a wall 48 so that the soundproof member 40*c* is attached to the wall 48. As shown in FIG. 12, the detaching mechanism 46 attached to the soundproof member 40*c* may be detached from the wall 48 so that the soundproof member 40*c* is detached from the wall 48.

Figure 13:
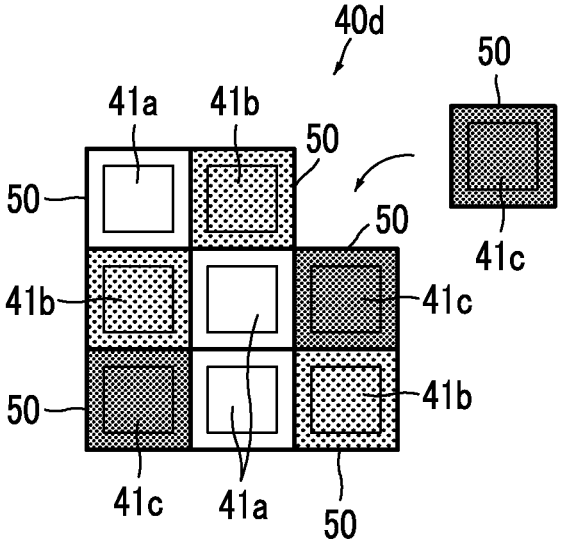
FIG. 13 is a plan view showing attachment and detachment of a unit cell in another example of the soundproof member having the soundproof structure according to the present invention.

In the case of adjusting the soundproofing characteristics of the soundproof member 40*d* by combining respective soundproof cells having different resonance frequencies, for example, by combining soundproof cells 41*a*, 41*b*, and 41*c* as shown in FIG. 13, it is preferable that the detaching mechanism 50, such as a magnetic material, a Magic Tape (registered trademark), a button, and a suction cup, is attached to each of the soundproof cells 41*a*, 41*b*, and 41*c* so that the soundproof cells 41*a*, 41*b*, and 41*c* are easily combined.

Figure 14:
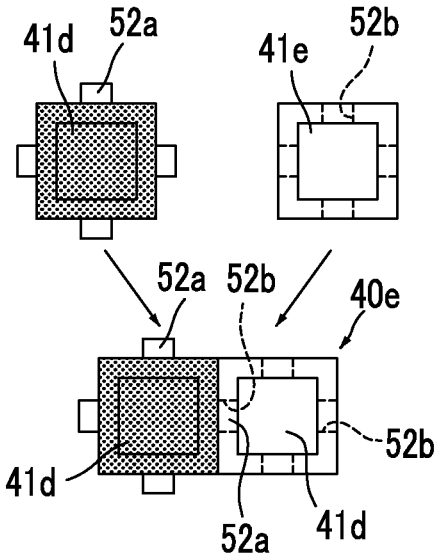
FIG. 14 is a plan view showing attachment and detachment of a unit cell in another example of the soundproof member having the soundproof structure according to the present invention.

In addition, an uneven portion may be provided in a soundproof cell. For example, as shown in FIG. 14, a protruding portion 52*a* may be provided in a soundproof cell 41*d* and a recessed portion 52*b* may be provided in a soundproof cell 41*e*, and the protruding portion 52*a* and the recessed portion 52*b* may be engaged so that the soundproof cell 41*d* and the soundproof cell 41*e* are detached from each other. As long as it is possible to combine a plurality of soundproof cells, both a protruding portion and a recessed portion may be provided in one soundproof cell.

Furthermore, the soundproof cells may be detached from each other by combining the above-described detaching mechanism 50 shown in FIG. 13 and the uneven portion, the protruding portion 52*a*, and the recessed portion 52*b* shown in FIG. 14.

[Mechanical Strength of Frame]

As the size of the soundproof member having the soundproof structure of the present invention increases, the frame easily vibrates, and a function as a fixed end with respect to film vibration is degraded. Therefore, it is preferable to increase the frame stiffness by increasing the thickness of the frame. However, increasing the thickness of the frame causes an increase in the mass of the soundproof member.

Figure 15:
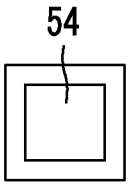
FIG. 15 is a plan view of an example of a soundproof cell of the soundproof structure of the present invention.
Figure 16:
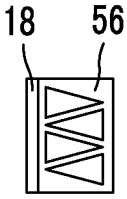
FIG. 16 is a side view of the soundproof cell shown in FIG. 15.
Figure 17:
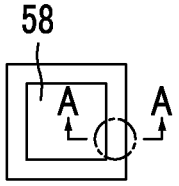
FIG. 17 is a plan view of an example of a soundproof cell of the soundproof structure of the present invention.
Figure 18:
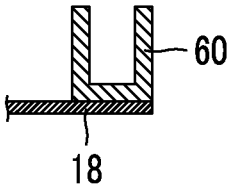
FIG. 18 is a schematic cross-sectional view of the soundproof cell shown in FIG. 17 as viewed from the arrow A-A.

This declines the advantage of the present soundproof member that is lightweight. Therefore, in order to reduce the increase in mass while maintaining high stiffness, it is preferable to form a hole or a groove in the frame. For example, by using a truss structure as shown in a side view of FIG. 16 for a frame 56 of a soundproof cell 54 shown in FIG. 15 or by using a Rahmem structure as shown in the A-A arrow view of FIG. 18 for a frame 60 of a soundproof cell 58 shown in FIG. 17, it is possible to achieve both high stiffness and light weight.

Figure 19:
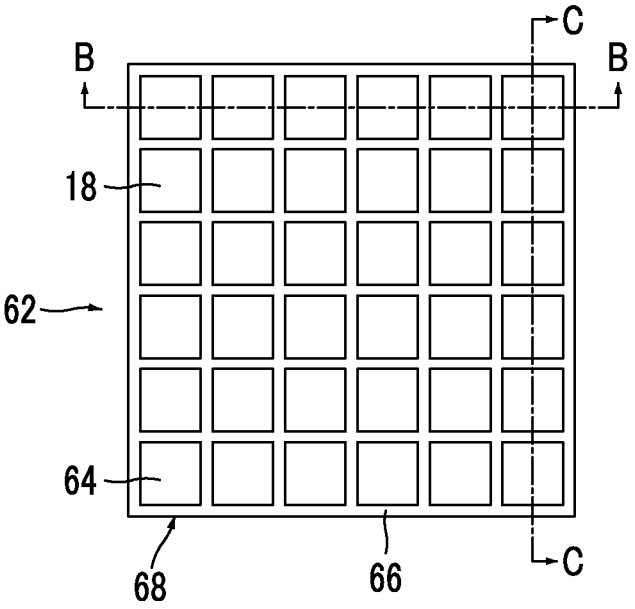
FIG. 19 is a plan view of another example of the soundproof member having the soundproof structure of the present invention.
Figure 20:
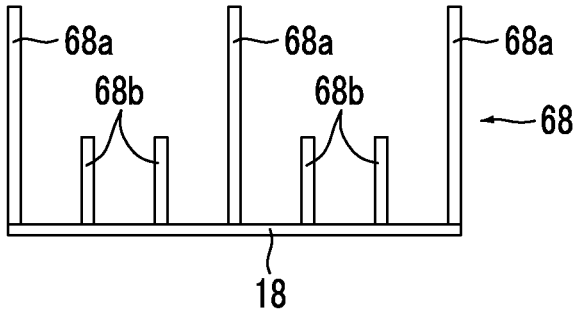
FIG. 20 is a schematic cross-sectional view of the soundproof member shown in FIG. 19 as viewed from the arrow B-B.
Figure 21:
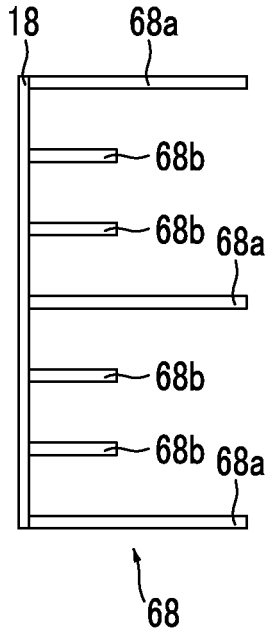
FIG. 21 is a schematic cross-sectional view of the soundproof member shown in FIG. 19 as viewed from the arrow C-C.

For example, as shown FIGS. 19 to 21, by changing or combining the frame thickness in the plane, it is possible to secure high stiffness and to reduce the weight. As in a soundproof member 62 having the soundproof structure of the present invention shown in FIG. 19, as shown in FIG. 20 that is a schematic cross-sectional view of the soundproof member 62 shown in FIG. 19 taken along the line B-B, frame members 68*a* on both outer sides and a central frame member 68*a* of a frame body 68 configured to include a plurality of frames 66 of 36 soundproof cells 64 are made thicker than frame members 68*b* of the other portions. In the illustrated example, the frame members 68*a* on both outer sides and the central frame member 68*a* are made two times or more thicker than the frame members 68*b* of the other portions. As shown in FIG. 21 that is a schematic cross-sectional view taken along the line C-C perpendicular to the line B-B, similarly in the direction perpendicular to the line B-B, the frame members 68*a* on both outer sides and the central frame member 68*a* of the frame body 68 are made thicker than the frame members 68*b* of the other portions. In the illustrated example, the frame members 68*a* on both outer sides and the central frame member 68*a* are made two times or more thicker than the frame members 68*b* of the other portions.

In this manner, it is possible to achieve both high stiffness and light weight.

For the sake of simplicity, a weight or a weight and a through-hole are not shown in the film 18 of each of the soundproof cells shown in FIGS. 9 to 21 described above. However, it is needless to say that a weight is disposed on each film 18 and a through-hole is drilled.

The soundproof structure of the present invention can be used as the following soundproof members.

For example, as soundproof members having the soundproof structure of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening portion (soundproof member installed in the window of a room to prevent noise from indoor or outdoor); a soundproof member for ceiling (soundproof member installed on the ceiling of a room to control the sound in the room); a soundproof member for internal opening portion (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for preventing leakage of noise around the construction site); and a soundproof member for tunnel (soundproof member installed in a tunnel to prevent noise leaking to the inside and outside the tunnel).

EXAMPLES

The soundproof structure of the present invention will be specifically described by way of examples, but the present invention is not limited thereto.

Example 1

As Example 1, the soundproof structure 10*a* having four soundproof cells 26 as shown in FIG. 1A was manufactured.

Specifically, in the soundproof structure 10*a*, a PET film (Lumirror manufactured by Toray Industries, Inc.) having a thickness of 188 μM as the film body 20 was bonded to the frame body 16 formed of aluminum, in which four through-holes of 25 mm square were drilled in a lattice pattern of 2×2.

The thickness of the frame body 16 was 3 mm, and the width of the frame was 2 mm.

The frame body 16 and the film body 20 were bonded to each other with a double-sided tape.

The weight 25 of iron having a diameter of 3 mm, a thickness of 1.5 mm, and a weight of 80 g was fixed to the central portion of the film 18 of the frame and film structure using a double-sided tape.

Then, the hole 22 having a diameter of 1 mm was drilled in the vicinity of the weight 25.

The process of drilling a hole was performed as follows.

First, a black spot intended for light absorption was drawn on the film 18 using black ink. In this case, the size of the black spot was made as close as possible to the size of a hole to be opened.

Then, green laser (300 mW) of a laser apparatus (Laser Diode manufactured by Nichia Corporation) was emitted to the black spot portion of the film.

Since the visible light absorbance of the PET film was sufficiently small, the laser was absorbed only into the black spot portion to generate absorption heat. Eventually, the hole 22 was opened in the black spot portion. Using an optical microscope (ECLIPSE manufactured by Nikon Corporation), the size of the hole 22 was measured. As a result, a circular hole having a diameter of 1 mm was able to be obtained.

In this manner, it is possible to manufacture the soundproof structure of Example 1 of the present invention.

Comparative Example 1

A soundproof structure was manufactured in the same manner as in Example 1 except that the hole 22 and the weight 25 were not provided.

Comparative Example 2

A soundproof structure was manufactured in the same manner as in Example 1 except that the hole 22 was not provided.

Reference Example 1

A soundproof structure was manufactured in the same manner as in Example 1 except that the weight 25 was not provided.

[Evaluation]

For the manufactured soundproof structures of Examples 1, Comparative Example 1 and 2, and Reference Example 1, the acoustic characteristics were measured.

The acoustic characteristics were measured by a transfer function method using four microphones in a self-made aluminum acoustic tube. This method is based on "ASTM E2611-09: Standard Test Method for Measurement of Normal Incidence Sound Transmission of Acoustical Materials Based on the Transfer Matrix Method". As the acoustic tube, for example, an acoustic tube based on the same measurement principle as WinZac manufactured by Nitto Bosei Aktien Engineering Co., Ltd. was used. It is possible to measure the sound transmission loss in a wide spectral band using this method.

The soundproof structures of Examples 1, Comparative Example 1 and 2, and Reference Example 1 were disposed in a measurement portion of the acoustic tube, and the sound transmission loss was measured in the range of 10 Hz to 40000 Hz. The measurement range was measured by combining a plurality of diameters of acoustic tubes or a plurality of distances between microphones. In general, as the distance between the microphones increases, the amount of measurement noise decreases at low frequencies. On the other hand, in a case where the distance between the microphones is larger than the wavelength/2 on the high frequency side, measurement cannot be performed in principle. Accordingly, measurement was performed multiple times while changing the distance between the microphones. In addition, since the acoustic tube is thick, measurement cannot be performed due to the influence of the higher order mode on the high frequency side. Therefore, measurement was performed using a plurality of types of diameters of the acoustic tube.

The absorbance of sound (energy of soundwaves) of each soundproof structure was calculated. The measurement method was performed by the transfer function method using the same four microphones as in the above measurement, and the absorbance was calculated from the measured transmittance and reflectivity.

Figure 5A:
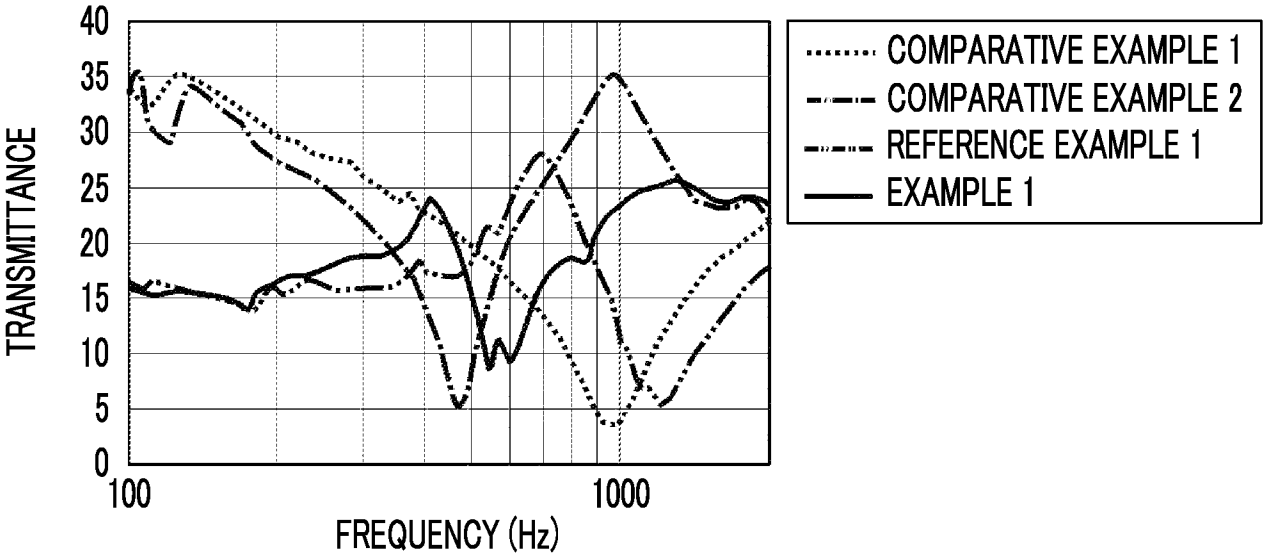
FIG. 5A is a graph showing the relationship between a frequency and a transmission loss in soundproof structures of respective examples including Example 1.
Figure 5B:
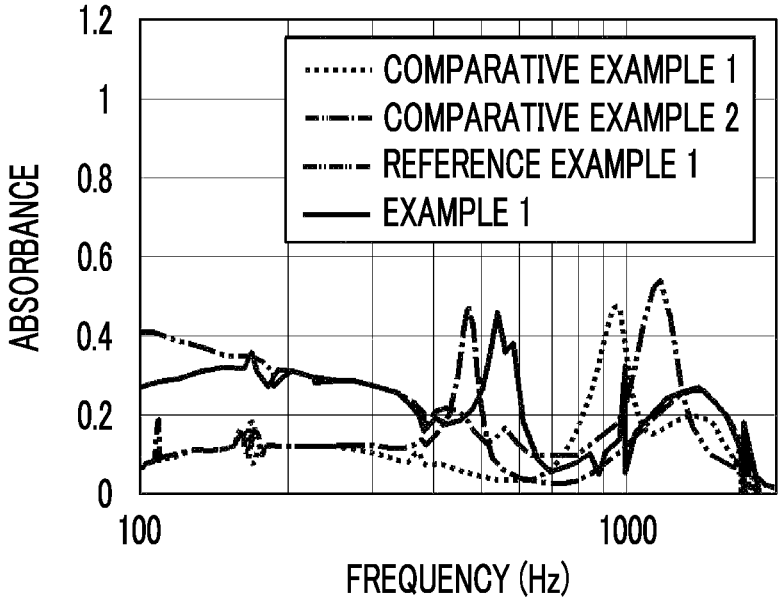
FIG. 5B is a graph showing the relationship between a frequency and an absorbance in soundproof structures of respective examples including Example 1.

The measurement result of the transmission loss is shown in FIG. 5A, and the measurement result of the absorbance is shown in FIG. 5B.

As is apparent from the result shown in FIG. 5A, in Example 1, the transmission loss is low at about 553 Hz that is the first natural vibration frequency, the first shielding peak frequency is present at about 405 Hz on the lower frequency side than the first natural vibration frequency, and the second shielding peak frequency is present at about 1200 Hz on the higher frequency side than the first natural vibration frequency. Accordingly, it is possible to selectively insulate sound in a predetermined frequency band centered on the first shielding peak frequency and sound in a predetermined frequency band centered on the second shielding peak frequency.

Therefore, it can be seen that an arbitrary frequency component can be appropriately shielded since the transmission loss can be made to be larger than that in Comparative Examples 1 and 2 at the first shielding peak frequency and the second shielding peak frequency.

From the result shown in FIG. 5B, it can be seen that, in all of the four soundproof structures, a strong absorption peak is present at the first natural vibration frequency.

In Example 1, compared with Comparative Example 1 and Comparative Example 2, absorption is large on the lower frequency side than the first natural vibration frequency. Therefore, in the present invention, it can be seen that not only can air permeability be obtained in a state having a shielding peak and but also the sound absorbing capability can be increased at low frequency.

Example 2

Figure 2:
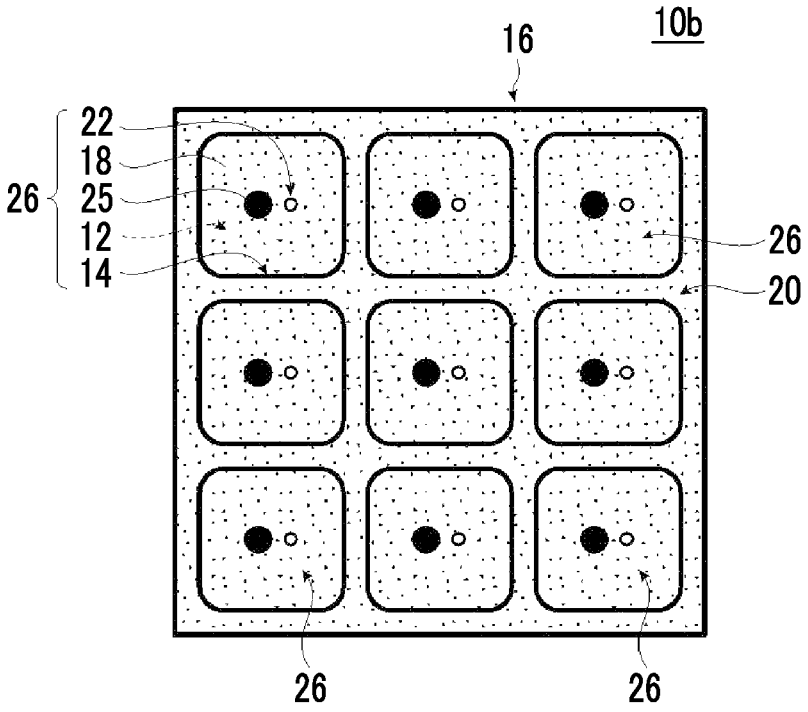
FIG. 2 is a plan view schematically showing another example of the soundproof structure according to the present invention.

As Example 2, the soundproof structure 10*b* having nine soundproof cells 26 as shown in FIG. 2 was manufactured.

Specifically, the soundproof structure 10*b* was manufactured in the same manner as in Example 1 except that the size of the through-hole 12 of the soundproof cell 26 was set to 20 mm square, the weight of the weight 25 was set to 132 g, and nine soundproof cells 26 were arranged.

FIG. 6 shows a measurement result of the transmission loss.

As shown in FIG. 6, the transmission loss is low at about 510 Hz that is the first natural vibration frequency, the first shielding peak frequency is present at about 450 Hz on the lower frequency side than the first natural vibration frequency, and the second shielding peak frequency is present at about 1336 Hz on the higher frequency side than the first natural vibration frequency. Accordingly, it is possible to selectively insulate sound in a predetermined frequency band centered on the first shielding peak frequency and sound in a predeteiiuined frequency band centered on the second shielding peak frequency.

Example 3

Next, as Example 3, computer simulation was performed for the soundproof structure 10*c* in which the hole 22 passing through the weight 25 was provided as shown in FIG. 3.

Specifically, the soundproof structure of Example 3 had the same configuration as in Example 2 except that the thickness of the film body was set to 100 μm, the weight 25 was a cylindrical aluminum weight having a thickness of 2 mm and a diameter of 5 mm and having a hollow portion with a diameter of 1 mm at the center, and the hole 22 was drilled in the film 18 in alignment with the hollow portion of the weight 25.

As a method of simulation, analysis was performed using coupled analysis of sound and vibration since the system of the soundproof structure of the present invention is an interaction system of film vibration and sound waves in air. Specifically, designing was performed using an acoustic module of COMSOL ver 5.0 that is analysis software of the finite element method. First, a first natural vibration frequency was calculated by natural vibration analysis. Then, by performing acoustic structure coupled analysis based on frequency sweep in the periodic structure boundary, transmission loss at each frequency with respect to the sound wave incident from the front was calculated.

The result is shown in FIG. 7.

As is apparent from the result shown in FIG. 7, in Example 3, the transmission loss is low at about 330 Hz that is the first natural vibration frequency, the first shielding peak frequency is present at about 263 Hz on the lower frequency side than the first natural vibration frequency, and the second shielding peak frequency is present at about 1584 Hz on the higher frequency side than the first natural vibration frequency. Accordingly, it is possible to selectively insulate sound in a predetermined frequency band centered on the first shielding peak frequency and sound in a predetermined frequency band centered on the second shielding peak frequency.

Examples 4 and 5

Next, as Examples 4 and 5, computer simulation was performed in the same manner as in Example 3 except that the thickness of the weight 25 was changed to 6 mm and 10 mm.

Figure 8:
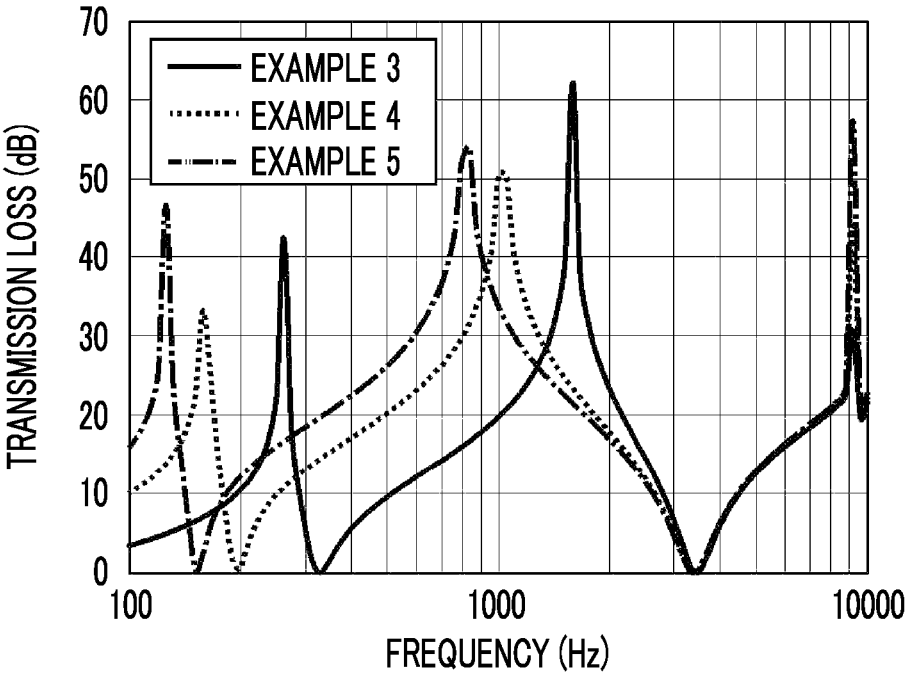
FIG. 8 is a graph showing the relationship between a frequency and a transmission loss in soundproof structures of Examples 3 to 5.

The result is shown in FIG. 8.

As is apparent from the result shown in FIG. 8, it can be seen that, as the thickness of the weight 25 increases, the first shielding peak frequency and the second shielding peak frequency change toward the low frequency side. This is due to an increase in the mass of the weight 25 and an increase in the length of the hole 22 (opening portion 24). From this result, it can be seen that the desired first shielding peak frequency and second shielding peak frequency can be obtained by adjusting the weight of the weight 25 and the shape of the hole 22.

While the soundproof structure of the present invention has been described in detail with reference to various embodiments and examples, the present invention is not limited to these embodiments and examples, and various improvements or modifications may be made without departing from the scope and spirit of the present invention.

EXPLANATION OF REFERENCES

10*a* to 10*c*: soundproof structure
12: through-hole
14, 56, 60, 66: frame
16, 68: frame body
18: film
20: film body
22: hole (through-hole)
24: opening portion
25: weight
26, 41*a*, 41*b*, 41*c*, 41*d*, 41*e*, 54, 58, 64: soundproof cell
40*a*, 40*b*, 40*c*, 40*d*, 62: soundproof member
42: cover
44: hole
46, 50: detaching mechanism
48: wall
52*a*: protruding portion
52*b*: recessed portion
68*a*, 68*b*: frame member

What is claimed is:

1. A soundproof structure, comprising:

one or more soundproof cells, wherein each of the one or more soundproof cells comprises a frame having a through-hole through which sound passes, a film fixed to the frame, an opening portion configured to include one or more holes drilled in the film, and a weight disposed on the film, one end portion of the frame opposite to other end portion to which the film is fixed is open, and the soundproof structure has a first shielding peak frequency, which is determined by the opening portion drilled in the film of each of the one or more soundproof cells and at which a transmission loss is maximized, on a lower frequency side than a first natural vibration frequency of the film of each of the one or more soundproof cells and a second shielding peak frequency, which is determined by the weight and at which a transmission loss is maximized, on a higher frequency side than the first natural vibration frequency of the film, and selectively insulates sound in a predetermined frequency band centered on the first shielding peak frequency and sound in a predetermined frequency band centered on the second shielding peak frequency.

2. The soundproof structure according to claim 1, wherein the one or more soundproof cells are a plurality of soundproof cells arranged in a two-dimensional manner.

3. The soundproof structure according to claim 1, wherein the first natural vibration frequency is determined by a geometric form of the frame of each of the one or more soundproof cells and stiffness of the film of each of the one or more soundproof cells, the first shielding peak frequency is determined according to an area of the opening portion drilled in the film of each of the one or more soundproof cells, and the second shielding peak frequency is determined according to a mass of the weight disposed on the film of each of the one or more soundproof cells.

4. The soundproof structure according to claim 2, wherein the first natural vibration frequency is determined by a geometric form of the frame of each of the one or more soundproof cells and stiffness of the film of each of the one or more soundproof cells, the first shielding peak frequency is determined according to an area of the opening portion drilled in the film of each of the one or more soundproof cells, and the second shielding peak frequency is determined according to a mass of the weight disposed on the film of each of the one or more soundproof cells.

5. The soundproof structure according to claim 1, wherein the first natural vibration frequency is determined by a shape and a size of the frame of each of the one or more soundproof cells and thickness and flexibility of the film of each of the one or more soundproof cells, and the first shielding peak frequency is determined according to an average area ratio of the opening portions drilled in the films of the one or more soundproof cells.

6. The soundproof structure according to claim 4, wherein the first natural vibration frequency is determined by a shape and a size of the frame of each of the one or more soundproof cells and thickness and flexibility of the film of each of the one or more soundproof cells, and the first shielding peak frequency is determined according to an average area ratio of the opening portions drilled in the films of the one or more soundproof cells.

7. The soundproof structure according to claim 1, wherein the first natural vibration frequency is included in a range of 10 Hz to 100000 Hz.

8. The soundproof structure according to claim 6, wherein the first natural vibration frequency is included in a range of 10 Hz to 100000 Hz.

9. The soundproof structure according to claim 1, wherein the opening portion drilled in the film of each of the one or more soundproof cells is formed by one hole.

10. The soundproof structure according to claim 8, wherein the opening portion drilled in the film of each of the one or more soundproof cells is formed by one hole.

11. The soundproof structure according to claim 1, wherein the opening portion drilled in the film of each of the one or more soundproof cells is formed by a plurality of holes having the same size.

12. The soundproof structure according to claim 10, wherein the opening portion drilled in the film of each of the one or more soundproof cells is formed by a plurality of holes having the same size.

13. The soundproof structure according to claim 1, wherein the opening portion is formed so as to pass through the weight.

14. The soundproof structure according to claim 12, wherein the opening portion is formed so as to pass through the weight.

15. The soundproof structure according to claim 1, wherein the weight has a cylindrical shape.

16. The soundproof structure according to claim 14, wherein the weight has a cylindrical shape.

* * * * *